United States Patent [19]

Kaiser

[11] Patent Number: 4,678,604

[45] Date of Patent: Jul. 7, 1987

[54] 2-(1'-HYDROXYIMINO-ETHYL)-1,3,3,4,4-PENTAMETHYLCYCLOPENTENE AND FRAGRANCE COMPOSITIONS CONTAINING SAME

[75] Inventor: Roman Kaiser, Uster, Switzerland

[73] Assignee: Givaudan Corporation, Clifton, N.J.

[21] Appl. No.: 900,555

[22] Filed: Aug. 26, 1986

[30] Foreign Application Priority Data

Sep. 13, 1985 [CH] Switzerland ..... 3974/85

[51] Int. Cl.[4] ..... C11B 9/00

[52] U.S. Cl. ..... 252/522 R; 564/253

[58] Field of Search ..... 564/253; 252/522 R

[56] References Cited

U.S. PATENT DOCUMENTS 4,544,714 10/1985 Ochaner ..... 252/522 R

FOREIGN PATENT DOCUMENTS 1205534 11/1965 Fed. Rep. of Germany ..... 564/253

3129934 2/1983 Fed. Rep. of Germany ... 252/522 R

OTHER PUBLICATIONS

Organikum Organisch-Chemisches Grundpraktikum, collective authors, 6th Edition, VEB Deutscher Verlag der Wissenschaften, Berlin, (1967), p. 375.

M. Kolobielski, Ann. Chim. 10, No. 12, (1955), pp. 271-290.

*Primary Examiner*—Werren B. Lone

*Attorney, Agent, or Firm*—Robert F. Tavares; Linda A. Vag

[57] ABSTRACT

2-(1'-Hydroxyimino-ethyl)-1,3,3,4,4-pentamethylcyclopentene is a novel odorant. A process for its manufacture, fragrance compositions containing same and methods for improving fragrance compositions by adding same thereto are disclosed.

10 Claims, No Drawings

2-(1'-HYDROXYIMINO-ETHYL)-1,3,3,4,4-PENTAMETHYLCYCLOPENTENE AND FRAGRANCE COMPOSITIONS CONTAINING SAME

THE INVENTION

The invention concerns the novel oxime 2-(1'-hydroxyiminoethyl)-1,3,3,4,4-pentamethylcyclopentene, I.

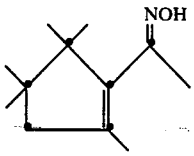

I

Formula I is intended to embrace both the syn and the anti forms of the oxime.

The invention also concerns a process for the manufacture of I and fragrance compositions containing same.

DESCRIPTION OF THE PREFERRED EMBODIMENTS

The process of the invention comprises reacting 2-acetyl-1,3,3,4,4-pentamethylcyclopentene, II,

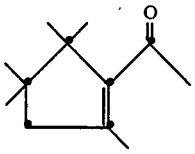

II with hydroxylamine or a salt thereof. This reaction can be carried out according to methods known per se. (See e.g. Organikum, Organisch-chemisches Grundpraktikum, collective authors; 7the Edition; VEB Deutscher Verlag der Wissenschaften; Berlin 1967, 375, 555.) The ketone II may be reacted with a hydroxylamine salt, (e.g. the hydrochloride or sulphate) in the presence of a base such as pyridine, sodium acetate, potassium acetate, etc., preferably in alcoholic solution. The reaction temperature is preferably the reflux temperature of the reaction mixture. The oxime I may be separated from the reaction mixture by known methods as distilling off the majority of the alcohol, adding an organic solvent, washing with water and finally removing the unreacted ketone.

The ketone starting material II is known. For example, M. Kolobielski in Ann. Chim. 10, No. 12, (1955), 271 et seq. describes the reductive dimerization of mesityl oxide with magnesium in acetic acid, leading to a mixture consisting essentially of 2-acetyl-1,3,3,4,4-pentamethyl-cyclopentanol II' as the main component and smaller amounts of 2-acetyl-1,3,3,4,4-pentamethylcyclopentene (II), 3,5-dimethyl-3-(2'methyl-1'-propen-1'yl)-4-hexen-2-one (or 2,4,6-trimethyl-4-acetyl-2,5-heptadiene) (IIb); 2,3,3,5-tetramethyl-2-isobutenyl-2,3-dihydrofuran (II'') and 2,4,5,7-tetramethyl-2,6-octadiene-4,5-diol (II''').

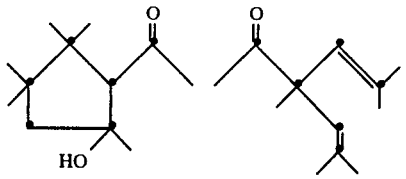

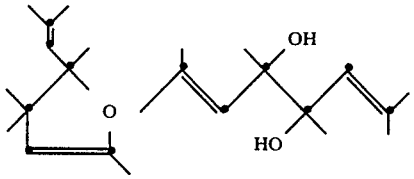

A product rich in II can be obtained readily by dehydration of the alcohol II'. This is done by treating the aforementioned product mixture with a base (e.g., aqueous sodium hydroxide solution) followed by purification of the acidified reaction mixture. The product remaining behind after removal of the readily volatile compounds contains, for example, 67% of II in addition to the acyclic ketones IIb (about 15%), IIc (about 7%) and IId (about 8%)

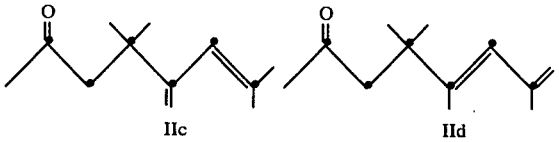

The ketone II can be obtained from this product mixture in pure form by column chromatography or in greatly enriched form by distillation. The purified ketone can be converted into I in accordance with the process of the invention. These further purification steps are not necessary however, as the acyclic oximes Ib, Ic and Id which are also formed during the oximation process from ketones IIb, IIc and IId respectively, do not in any manner negatively influence the olfactory value of I.

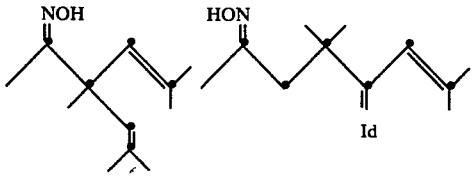

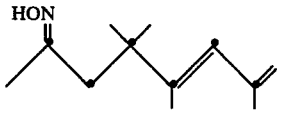

The oxime I and accordingly the oxime mixture of I, Ib, Ic and Id as described above have particular organoleptic properties, on the basis of which they are excellently suited as an odorant substances. They are distinguished by a particular combination of valuable properties. They are colorless, readily accessible, the individual batches are constant in odor, non-irritant, stable and convenient to handle.

The oxime of formula I has, in particular, the characteristic olfactory aspect of the fresh flowers of *Salvia sclarea* (clary sage), this odor being accompanied by herbaceous nuances.

The olfactory notes of the acyclic oximes are:

Ib: woody-amber like,

Ic: herbaceous with the typical aspects of rhubarb leaves and tomato leaves,

Id: sweet, anise-like, aspects of basil and grapefruit.

The odor of the mixture of I with the acyclic oximes Ib, Ic and Id as prepared by the process of the invention is found to be a harmonic combination of the olfactory aspects stated above, whereby the characteristic note reminiscent of flowering clary sage clearly dominates.

The only known organoleptically active, cycloaliphatic oxime (namely a compound with an oxime grouping directly on a ring carbon atom) described in the prior art (DT-OS No. 3,129,934, Dragoco) is 1,5-dimethyl-8-hydroxyimino-bicyclo[3.2.1]octane. The odor is described as that of blackcurrants. The organoleptic properties of I are therefore completely different from the organoleptic properties of this known oxime.

A further important and typical property of the novel oxime I in accordance with the invention consists in its high integration capability in the creation of perfume compositions. (By integration capability is meant the ability of an odorant to harmonize with notes throughout the total fragrance, i.e., the "top", "middle" and "bottom notes".) In contrast to the majority of the previously known oximes, which according to their olfactory characteristics have been used especially for the modification of the "top notes" of compositions, the novel oxime I displays its full effect particularly in the moderately-volatile to low-volatile range of the composition in that it enriches, harmonizes or modifies the desired olfactory complex and fixes the same in an excellent manner.

On the basis of its olfactory properties, its high integration capability and its fixative properties the novel oxime I or its mixture is especially suitable for modifying flowery compositions, e.g. of the "white flower" type (such as lily-of-the-valley, honeysuckle, etc.) in that here the olfactory aspects of monoterpene derivatives such as linalool and citronellol are brought into accord harmoniously with those of the sesquiterpene derivatives such as nerolidol and farnesol and thus in addition more radiance is conferred to this olfactory aspect, and of the "exotic flower" type (such as champaca, osmanthus, etc.) in that more diffusion and transparency is conferred to the composition by an underlining of the fresh-flowery aspects;

compositions of the cologne type in that here the effects of the different agrumen oils are brought into harmonic accord and an elegant transition to the woody notes appears;

compositions with pronounced woody notes where a uniform transition from the highly-volatile to the low-volatile constituents is brought about and the resulting composition gains considerably in elegance by the special olfactory properties of the oxide I.

The compound I combines with numerous known fragrance materials of natural or synthetic origin, whereby the range of the natural raw materials can embrace not only high-volatile, but also moderately-volatile and low-volatile components and that of the synthetics can embrance representatives from practically all classes of substances, as is evident from the following compilation:

Natural products, such as angelica seed oil, tree moss absolute, basil oil, mugwort oil, bergamot oil, castoreum, acetylated cedarwood oil (Cedartone TM Givaudan), coriander oil, oak moss, elemi oil, galbanum oil, geranium oil, jasmine absolute and its substitutes, camomile oil, lavandin oil, lavender oil, mandarin oil, mastix absolute, clove bud oil, neroli oil, patchouli oil, petitgrain oil Paraguay, rose oil, rosemary oil, sandalwood oil, styrax, vetiver oil, wormwood oil, ylang-ylang oil, hyssop oil, civet oil, lemon oil;

alcohols, such as citronellol, dimethylbenzylcarbinol, Dimetol ® Givaudan (2,6-dimethyl-2-heptanol), geraniol, linalool, menthol, 3-methyl-5-(2',2',3'-trimethylcyclopent-3'-en-1'-yl)-pentan-2-ol (Sandalore ® Givaudan), nerol, phenylethyl alcohol, phenylpropyl alcohol, natural rhodinol, α-terpineol, cinnamic alcohol, farnesol;

aldehydes, such as α-amylcinnamic aldehyde, citral, cyclamen aldehyde, decanal, 3,5-dimethyl-cyclohex-3-ene-carboxyaldehyde, n-dodecanal, heliotropin, α-hexylcinnamic aldehyde, hydroxycitronellal, methylnonyl acetaldehyde, p-tert.butyl-α-methyl-dihydro-cinnamic aldehyde (Lilial ® Givaudan), n-undecen-10-al;

esters, such as ethyl acetoacetate, 3-ethyl-1,1-dimethyl-cyclohex-3-ene-2-carboxylic acid ethyl ester (Givescone TM Givaudan), 3-ethyl-1,1,4-trimethyl-cyclohex-3-ene-2-carboxylic acid ethyl ester (Myrascone TM Givaudan), amyl salicylate, benzyl acetate, benzyl salicylate, bornyl acetate, cedryl acetate, cinnamyl formate, cis-3-hexenyl acetate, cis-3-hexenyl benzoate, geranyl acetate, hexyl salicylate, isobutyl salicylate, linalyl acetate, linalyl anthranilate, methyl dihydrojasmonate, 4-(4-methyl-3-pentenyl)-cyclohex-3-en-1-yl-carbinyl acetate (Myraldyl acetate TM Givaudan), $\Delta^1$-1,5,9,10-tetramethyl-5-formoxy-octalin, phenylethyl acetate, styrallyl acetate, terpenyl acetate, p-tert.butyl-cyclohexyl acetate, benzyl benzoate, allyl phenoxyacetate;

lactones, such as coumarin, γ-decalactone, γ-dodecalactone, γ-nonalactone, γ-undecalactone;

various additional components often used in perfumery, such as acetaldehyde propyl-phenyl ethyl acetal (Acetal TM Givaudan), cyclocitrylideneacetonitrile, 1,1-dimethyl-4-acetyl-6-tert.butylindane, eugenol, 1,3,4,6,7,8-hexahydro-4,6,6,7,8,8-hexamethylcyclopenta-γ-2-benzopyran, 7-acetyl-1,1,3,4,4,6-hexamethyltetralin (Fixolide ® Givaudan), indol, isobutylquinoline, p-menthane-8-thiol-3-one, methyleugenol, methyl 1-methyl-cyclododecyl ether (Madrox TM Givaudan), 8,12-oxido-13,14,15,16-tetranorlabdane, 12-oxahexadecanolide;

The compositions manufactured with I can be used for all kinds of perfumed consumer goods (eau de cologne, eau de toilette, extracts, lotions, creams, shampoos, soaps, salves, powders, deodorants, detergents, tobacco, etc.).

By virtue of its remarkably high integration capability the content of I in perfume bases can readily amount to up to 80% and in the perfume compositions manufactured therewith up to 20–30% of this base can be used without difficulties to produce the desired effect.

On the other hand, however, the experienced perfumer can produce interesting olfactory nuances even with concentrations of 0.1–0.5%, so that the concentrations employed cover a very wide range.

The preferred concentrations usually range between 0.05% and 10%. As mentioned above, the compositions manufactured with I can be used for all kinds of perfumed consumer goods.

The compound I can accordingly be used in the manufacture of compositions and, as will be evident from the above compilation, a wide range of known odorant substances can be used. In the manufacture of such compositions the known odorant substances enumerated above can be used according to methods known to the perfumer, such as e.g. from W. A. Poucher, Perfumes, Cosmetics and Soaps 2, 7th Edition, Chapman and Hall, London, 1974.

EXAMPLE 1

Hydroxylamine hydrochloride (250 g) is dissolved in 2.5 l of ethanol and 250 g of pyridine in a 5 liter reaction vessel provided with a stirrer, a thermometer and a condenser. The mixture is stirred at room temperature for a quarter of an hour and 250 g of a ketone mixture of II, IIb, IIc, IId are then added to the solution. The reaction mixture is held at reflux temperature for 2 hours and then about ¾ of the ethanol used is removed by distillation. After cooling, the residue is poured onto ice/water and the product is extracted with ether. The ether phase is washed 3 times with dilute hydrochloric acid and 3 times with sodium chloride solution and dried with sodium sulphate. Distillation of the crude product obtained after evaporation of the ether over a 30 cm Widmer column gives 168 g of olfactorily good oxime mixture of boiling point 100°–101°/0.06 mmHg, which contains approximately 67% of I, 15% of Ib, 7% of Ic and 8% of Id.

For the characterization of the compounds I, Ib, Ic and Id, the thus-obtained oxime product mixture is separated into the individual components by column chromatography on a 100-fold amount of silica gel using hexane/ether 10:1 as the elution agent.

I: 2-(1'-Hydroxyimino-ethyl)-1,3,3,4,4-pentamethylcyclopentene

IR($CHCl_3$): 3580, 3230, 980, 890, 870 $cm^{-1}$ $^1$H-NMR (400 MHz): 0.90 and 0.92 (in each case 2 converging s, $2CH_3$—C(3) and $2CH_3$—C(4)); 1.65 (s, $CH_3$—C(1)); 1.98 (s, $CH_3$—C(1')); 2.08 (s, 2H—C(5)).

MS: 195 (M+, 20), 180 (100), 162 (13), 148 (23), 138 (11), 122 (19), 107 (9), 95 (11), 91 (14), 79 (10), 67 (7), 55 (15), 41 (43).

Ib: 3,5-Dimethyl-3-(2'-methyl-propen-1'-yl)-4-hexen-2-one oxime

IR: 3260, 1655, 1060, 1000, 940, 910, 835 $cm^{-1}$ $^1$H-NMR(400 MHz): 1.37 (s, 3H); 1.59 and 1.70 (in each case 2s with fine separation, in each case 6H): 1.81 (s, 3H); 5.40 (2 converging s with fine structure, 2H).

MS: 195 (M+, 5), 178 (100), 163 (28), 148 (41), 136 (11), 122 (54), 107 (27), 95 (34), 91 (28), 79 (21), 67 (25), 55 (40), 41 (83).

Ic: 5-Methylene-4,4,7-trimethyl-6-octen-2-one oxime

IR: 3230, 1655, 1618, 1125, 1062, 1028 965, 900 $cm^{-1}$ $^1$H-NMR(400 MHz): 1.08 (2 converging s, 6H); 1.73 and 1.80 (in each case s with fine structure, in each case 3H); 1.74 (s, 3H); 2.28 (s, 2H); 4,80 and 5.05 (in each case s with fine structure, in each case 1H); 5.83 (s with fine separation, 1H); 8.0–8.5 (broad signal of the oxime proton).

MS: 195 (M+, 7); 180 (18), 178 (35), 162 (4), 152 (8), 139 (14), 122 (47), 110 (51), 107 (26), 95 (37), 91 (22), 81 (100), 69 (41), 67 (41), 59 (36), 55 (32), 41 (8).

Id: 4,4,5,7-Tetramethyl-5,7-octadien-2-one oxime

IR: 3220, 1630, 1120, 1038, 965, 890 $cm^{-1}$ $^1$H-NMR(400 MHz): 1.10 (2 converging s, 6H); 1.79 and 1.82 (in each case s with fine structure, in each case 3H); 1.80 (s, 3H); 2.30 (s, 2H); 4.72 and 4.98 (in each case s with fine structure, in each case 1H); 5.66 (s, 1H); about 8.0–8.5 (broad signal of the oxime proton).

MS: 195 (M+, 1); 180 (7), 139 (24), 138 (24), 123 (63), 122 (96), 107 (19), 95 (29), 91 (22), 81 (100), 67 (30), 55 (7), 41 (56).

PREPARATION OF THE STARTING MATERIAL

The product mixture (200 g) obtained by the reductive dimerization of mesityl oxide (see M. Kolobielski, Ann. Chim. 10, (1955), 271 et seq., especially 291) is dissolved in 300 ml of methanol, treated with 10 ml of 40% sodium hydroxide solution and the mixture is thereupon stirred at reflux temperature for one hour. The mixture is subsequently cooled to 0°–10° C., carefully acidified with dilute sulphuric acid and stirred at room temperature for 30 minutes. After the usual working-up there remain 150 g of crude product from which there are obtained by distillation over a 20 Widmer column 60 g of ketone mixture consisting of II (about 67%), IIb (about 15%), IIc (about 7%) and IId (about 8%).

In Examples 2 and 3 hereinafter the term "novel compound I" means a mixture of I in combination with the acyclic oximes, as is accessible e.g. in accordance with Example 1.

EXAMPLE 2

| Flowery composition | Parts by weight |
|---|---|
| Rhodinol (natural) | 200 |
| Hydroxycitronellal | 200 |
| Benzyl benzoate | 100 |
| Farnesol | 180 |
| Linalool | 80 |
| cis-3-Hexenyl benzoate | 50 |
| Methyl dihydrojasmonate | 40 |
| Lilial ® | 30 |
| Sandalwood oil | 30 |
| | 910 |

By adding 50 parts of the novel compound I, this flowery composition, which is reminiscent of lily-of-the-valley, gains considerably in radiance, in that now the rhodinol note in the composition is underlined very advantageously and is in harmonic accord with the low-volatile constituents. Moreover, a very natural fresh aspect confers to the composition the impression of dew-fresh flowers. These extraordinarily positive aspects can even be ascertained in the bottom note of the composition. By adding 100 parts of the novel compounds the composition is modified in a similar direction, although now, in addition, an elegant, woody aspect and an aspect reminiscent of clary sage manifests itself strongly in the bottom note.

EXAMPLE 3

| Cologne composition | Parts by weight |
|---|---|
| Bergamot oil | 300 |
| Lemon oil | 300 |
| Petitgrain oil Paraguay | 50 |
| Mandarin oil | 50 |
| Hydroxycitronellal | 50 |
| Methyl dihydrojasmonate | 40 |
| Basil oil | 30 |
| Madrox TM | 30 |
| Givescone TM | 20 |
| Sandalore ® | 20 |
| 1,3,4,6,7,8-Hexahydro-4,6,6,7,8,8-hexamethylcyclopenta-γ-2-benzopyran | 20 |
| Rhodinol (natural) | 20 |
| Vetivenyl acetate | 20 |
| Tree moss absolute, 50% in dipropylene glycol | 10 |
| Eugenol | 10 |
| Ylang-ylang oil | 10 |
| | 980 |

An addition of 50 parts of the novel compound I herein has an extraordinarily positive effect on the top note in that the various agrumen oils which are present undergo a harmonization which can be described as ideal. Moreover, the woody aspect which appears in the bottom note gains significantly in elegance and radiance. Further, an amber-like note and a note reminiscent of clary sage appears in the top note and in the bottom note. Similar effects are even produced by adding 20 parts of the novel compound I.

I claim:

1. 2(1'-Hydroxyimino-ethyl)-1,3,3,4,4-pentamethylcyclopentene.

2. A mixture consisting essentially of 2-(1'-hydroxyimino-ethyl)-1,3,3,4,4-pentamethylcyclopentene, 3,5-dimethyl-3-(2'-methyl-propen-1'-yl)-4-hexen-2-one oxime, 5-methylene-4,4,7-trimethyl-6-octen-2-one oxime and 4,4,5,7-tetramethyl-5,7-octadien-2-one oxime.

3. A mixture in accordance with claim 2 consisting essentially of about 67% 2-(1'-hydroxyimino-ethyl)-1,3,3,4,4-pentamethylcyclopentene, 15% 3,5-dimethyl-3-(2'-methyl-propen-1'-yl)-4-hexen-2-one oxime, 7% 5-methylene-4,4,7-trimethyl-6-octen-2-one oxime and 8% 4,4,5,7-tetramethyl-5,7-octadien-2-one oxime.

4. A fragrance composition comprising an olfactorily effective amount of 2-(1'hydroxyimino-ethyl)-1,3,3,4,4-pentamethylcyclopentene and at least one other olfactory agent.

5. A fragrance composition comprising an olfactorily effective amount of a mixture consisting essentially of 2-(1'hydroxyimino-ethyl)-1,3,3,4,4-pentamethylcyclopentene, 3,5-dimethyl-3-(2'-methyl-propen-1'-yl)-4-hexen-2-one oxime, 5-methylene-4,4,7-trimethyl-6-octen-2-one oxime and 4,4,5,7-tetramethyl-5,7-octadien-2-one oxime and at least one other olfactory agent.

6. A fragrance composition in accordance with claim 5 wherein the mixture consists essentially of about 67% 2-(1'-hydroxyiminoethyl)-1,3,3,4,4-pentamethylcyclopentene, 15% 3,5-dimethyl-3-(2'-methyl-propen-1'-yl)-4-hexen-2-one oxime, 7% 5-methylene-4,4,7-trimethyl-6-octen-2-one oxime and 8% 4,4,5,7-tetramethyl-5,7-octadien-2-one oxime.

7. A method for improving the odor of a fragrance composition which comprises adding thereto an olfactorily effective amount of 2-(1'hydroxyimino-ethyl)-1,3,3,4,4-pentamethylcyclopentene.

8. A method for improving the odor of a fragrance composition which comprises adding thereto an olfactorily effective amount of a mixture consisting essentially of 2-(1'hydroxyimino-ethyl)-1,3,3,4,4-pentamethylcyclopentene, 3,5-dimethyl-3-(2'-methyl-propen-1'-yl)-4-hexene-2-one oxime, 5-methylene-4,4,7-trimethyl-6-octen-2-one oxime and 4,4,5,7-tetramethyl-5,7-octadien-2-one oxime.

9. A method in accordance with claim 8 wherein the mixture consists essentially of about 67% 2-(1'-hydroxyiminoethyl)-1,3,3,4,4-pentamethylcyclopentene, 15% 3,5-dimethyl-3-(2'-methyl-propen-1'-yl)-4-hexen-2-one oxime, 7% 5-methylene-4,4,7-trimethyl-6-octen-2-one oxime and 8% 4,4,5,7-tetramethyl-5,7-octadien-2-one oxime.

10. A process for the manufacture of 2-(1'-hydroxyimino-ethyl)-1,3,3,4,4-pentamethylcyclopentene, which comprises reacting 2-acetyl-1,3,3,4,4-pentamethylcyclopentene with hydroxylamine or a salt thereof.

* * * * *